US005164769A

United States Patent [19]

Hashimoto et al.

[11] Patent Number: 5,164,769

[45] Date of Patent: Nov. 17, 1992

[54] METHOD AND APPARATUS FOR CONTROLLING DATA COMMUNICATION IN A COPYING SYSTEM

[75] Inventors: Kenji Hashimoto, Komae; Shozo Miyawaki, Urawa, both of Japan

[73] Assignee: Ricoh Company, Ltd., Tokyo, Japan

[21] Appl. No.: 707,222

[22] Filed: May 24, 1991

Related U.S. Application Data

[63] Continuation of Ser. No. 370,738, Jun. 23, 1989, abandoned.

[30] Foreign Application Priority Data

Jun. 24, 1988 [JP] Japan ..... 63-156324

[51] Int. Cl.[5] ..... G03G 21/00

[52] U.S. Cl. ..... 355/202; 355/46; 355/323

[58] Field of Search ..... 355/46, 323, 202

[56] References Cited

U.S. PATENT DOCUMENTS 4,698,772 10/1987 Carter et al. ..... 355/323

4,750,731 6/1988 Dei et al. ..... 355/323

*Primary Examiner*—Monroe H. Hayes

*Attorney, Agent, or Firm*—Oblon, Spivak, McClelland, Maier & Neustadt

[57] ABSTRACT

A method and apparatus for controlling data communication in a copying system which is provided with a copying machine and a plurality of peripheral units cooperating with the copying machine. The copying machine has a single serial transmitting port. Data from the copying machine is first transmitted to one of the peripheral units through the serial transmitting port. Then, a connection between the serial transmitting port and the one of the peripheral units is electrically switched to a connection between the serial transmitting port and the other of the peripheral units. Thereafter, data from the copying machine is transmitted to the other of the peripheral units through the same serial transmitting port.

36 Claims, 13 Drawing Sheets

Fig. 10

| LOWER ORDER BITS \ UPPER ORDER BITS | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0 | | BIN ADDRESS (1~60) | | | | | | | | REVERSE OFF | MOTOR OFF | | | DL | | |
| 1 | | | | | | | | | | REVERSE ON | MOTOR ON | | A3 | LT | | |
| 2 | | | | | | | | | | | | | | | | |
| 3 | | | | | | | | | | | | | B4 | | | |
| 4 | | | | | | | | | | | RESET | | A4 | LG | | |
| 5 | | | | | | | | | | | | | | | | |
| 6 | | | | | | | | | | | | | B5 | | | |
| 7 | | | | | | | | | | | | | | | | |
| 8 | | | | | | | | | | | | | | | | |
| 9 | | | | | | | | | | | | | | | | |
| A | | | | | | | | | | | DUMMY | | | | | |
| B | | | | | | | | | | | | | | | | |
| C | | | | | | | | | | | | | | | | |
| D | | | | | | | | | | | | | | | | |
| E | | | | | | | | | | | | | | | | |
| F | | | | | | | | | | | | | | | | RETRY |

Fig. 11

| LOWER ORDER BITS \ UPPER ORDER BITS | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0 | | BIN ADDRESS (1 ~ 60) | | | | | 1 ~ 10 NOT | 1~20 CLOSE | 1~ 20 NO JAM | | | | | | | |
| 1 | | | | | | | 1 ~ 10 YES | 1 ~ 20 OPEN | 1 ~ 20 JAM | | | | | | | |
| 2 | | | | | | | 11~20 NOT | | | | | | | | | |
| 3 | | | | | | | 11 ~ 20 YES | | | | | | | | | |
| 4 | | | | | | | 21~30 NOT | 21~40 CLOSE | 21~40 NO JAM | | | | | | | |
| 5 | | | | | | | 21~30 YES | 21~40 OPEN | 21~40 JAM | | | | | | | |
| 6 | | | | | | | 31~ 40 NOT | | | | | | | | | |
| 7 | | | | | | | 31~ 40 YES | | | | | | | | | |
| 8 | | | | | | | 41~50 NOT | 41~60 CLOSE | 41~ 60 NO JAM | | | | | | | |
| 9 | | | | | | | 41~50 YES | 41~60 OPEN | 41~60 JAM | | | | | | | |
| A | | | | | | | 51~60 NOT | | | | DUMMY | | | | | |
| B | | | | | | | 51~60 YES | | | | | | | | | |
| C | | | | | | | | | | | | | | | | |
| D | | | | | | | | | | | | | | | | |
| E | | | | | | | | | | | | | | | | |
| F | | | | | | | | | | | | | | | | RETRY |

METHOD AND APPARATUS FOR CONTROLLING DATA COMMUNICATION IN A COPYING SYSTEM

This application is a continuation of application Ser. No. 07/370,738, filed on Jun. 23, 1989, now abandoned.

BACKGROUND OF THE INVENTION

The present invention relates to a method and apparatus for controlling data communication in a copying system.

Recent copying machines must speedily and exactly handle a large number of and various types of documents. To meet such requirements, the copying machine is systematized. For example, it is used in combination of peripheral machines, such as an automatic document feeder (ADF) and sorters.

In such a systematized copying machine (referred to as a copying system), the copying machine contains a host CPU, and the peripheral machines also contain slave CPUs. The slave CPUs are under control of the host CPU via an interface. For the data communication among those CPUs, the copying machine is provided with a plurality of serial ports to respectively be coupled with the ADF and sorters. Also each of the sorters has a plurality of serial ports to be coupled with the copying machine and the other sorters. Use of the plurality of serial ports is uneconomical and will increase the cost to manufacture.

SUMMARY OF THE INVENTION

It is therefore an object of the present invention to provide data communication method and apparatus for a copying system having a copying machine and peripheral units, in which the data communication between the copying machine and the peripheral units and between the peripheral units is performed by using a single serial port of the copying machine and by using single serial ports of the peripheral units.

According to one aspect of the present invention, there is provided a method of controlling data communication in a copying system which is provided with a copying machine and a plurality of peripheral units cooperating with the copying machine, the copying machine having a single serial transmitting port, the method comprising the steps of transmitting data from the copying machine to one of the peripheral units through the serial transmitting port, electrically switching a connection between the serial transmitting port and the one of the peripheral units to a connection between the serial transmitting port and the other of the peripheral units, and transmitting data from the copying machine to the other of the peripheral units through the serial transmitting port.

According to another aspect of the present invention, there is provided a method of controlling data communication in a copying system which is provided with a copying machine and a plurality of peripheral units cooperating with the copying machine, the copying machine having a single serial receiving port, the method comprising the steps of receiving data from one of the peripheral units through the serial receiving port, electrically switching a connection between the serial receiving port and the one of the peripheral units to a connection between the serial receiving port and the other of the peripheral units, and receiving data from the other of the peripheral units through the serial receiving port.

According to yet another aspect of the present invention, there is provided a method of controlling data communication in a copying system which is provided with a copying machine and a plurality of peripheral units cooperating with the copying machine, the copying machine having a single serial transmitting port and a single serial receiving port, the method comprising the steps of transmitting data from the copying machine to one of the peripheral units through the serial transmitting port, receiving data from one of the peripheral units through the serial receiving port, electrically switching a connection between the serial transmitting port and the one of the peripheral units to a connection between the serial transmitting port and the other of the peripheral units, and switching a connection between the serial receiving port and the one of the peripheral units to a connection between the serial receiving port and the other of the peripheral units, transmitting data from the copying machine to the other of the peripheral units through the serial transmitting port, and receiving data from the other of the peripheral units through the serial receiving port.

Additionally, there are provided apparatuses for executing the above-mentioned methods for controlling data communication in a copying system.

With such arrangements, the serial data communication between the copying machine and the sorter is performed by using a single serial port of the copying machine and alternately in a time divisional manner. The use of the single serial port of the interface of the copying machine leads may provide an inexpensive serial interface arrangement, and consequently leads to reduction of cost to manufacture.

In the copying system, when a plurality of the sorters are used, a first sorter is coupled with the copying machine, and is coupled with the remaining sorters. The data communication among the plurality of sorters are performed during the data communication between the copying machine and the first sorter. The interface of each sorter accepts only the data necessary for the sorter per se.

Accordingly, an effective data communication is realized in the copying system, and by using the interfaces each having a single serial port.

Other objects, features, and advantages of the present invention will be apparent from the following detailed description of the preferred embodiment as illustrated in the accompanying drawings, in which:

BRIEF DESCRIPTION OF THE DRAWINGS

FIG. 10 shows a code map of the data transferred from the copying machine to the sorters; and FIG. 11 shows a code map of the data transferred from the sorters to the copying machine.

DETAILED DESCRIPTION OF THE PREFERRED EMBODIMENT

A preferred embodiment of a copying system according to the present invention will be described with reference to the accompanying drawings.

Figure 1:
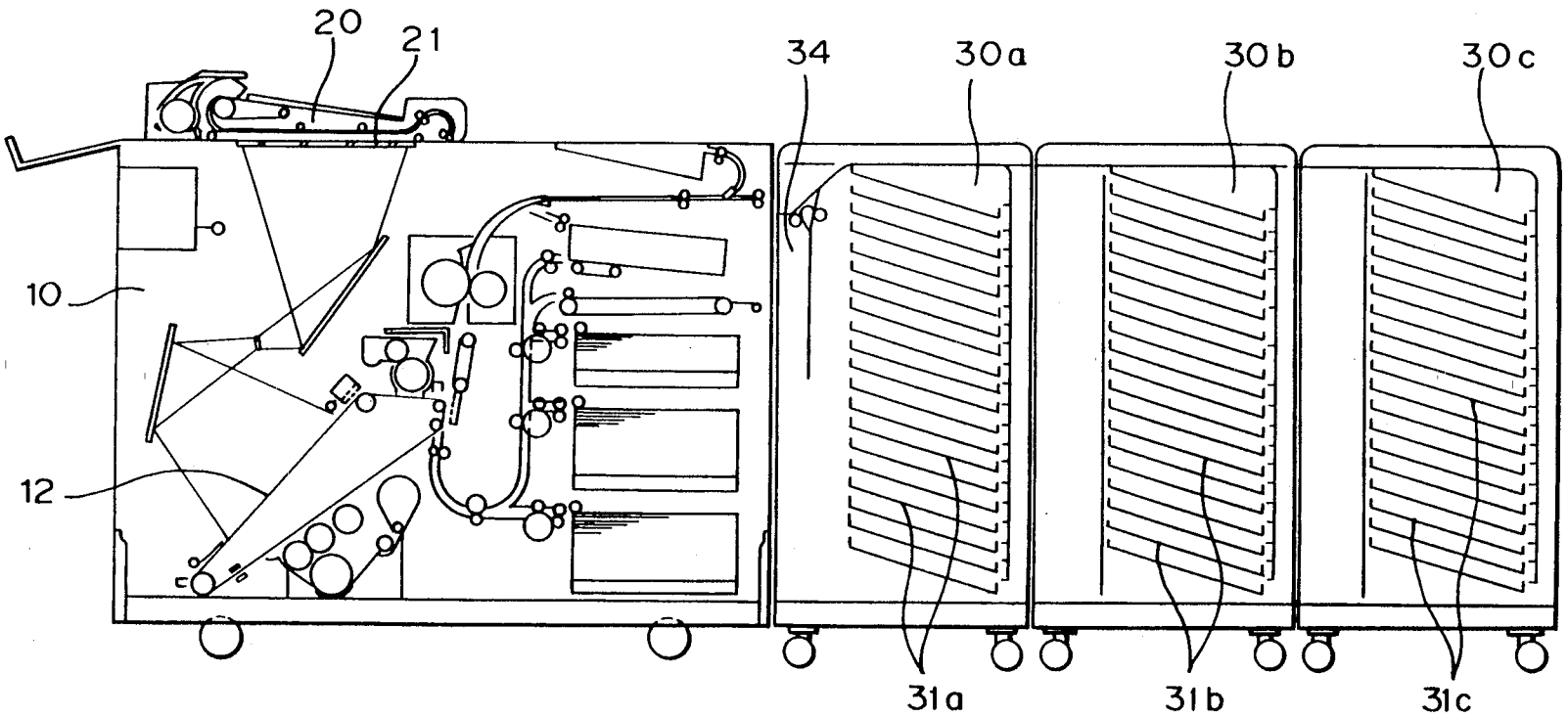
FIG. 1 is a longitudinal sectional view showing a copying system according to an embodiment of the present invention, the copying system being made up of a copying machine, an automatic document feeder (ADF), and first to third sorters.

An overall configuration of a copying system which is an embodiment of the present invention is schematically illustrated in FIG. 1. The copying system is constituted by a copying machine 10, an automatic document feeder (ADF) 20, and three sorters 30*a*, 30*b* and 30*c*. The copying machine 10 contains image forming process members 11 such as a belt like photosensitive member. The ADF 20 is placed on the top of the copying machine 10. The ADF 20 automatically feeds a set of originals such as documents to be copied to a document table 21 in the top surface of the copying machine. On the exit side of the copying machine 10, the three sorters 30*a* to 30*c* are located side by side. In this instance, three sorters are used, but if required, it may be larger or smaller than three. The first to third sorters 30*a* to 30*c* are provided with bin rows 31*a* to 31*c*, respectively, for receiving sorted copies, or copied papers, which are arrayed in parallel and slanting to the right (as viewed in the drawing). The first sorter 30*a* closest to the copying machine 10 uses a reversing unit 34 for reversing copies.

Figure 2:
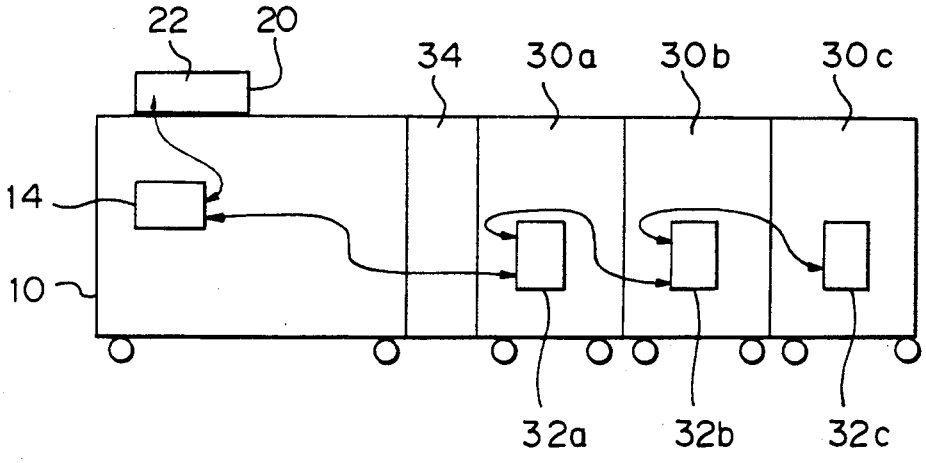
FIG. 2 is a wiring diagram showing a wiring of the serial interfaces used in the copying system shown in FIG. 1.
Figure 3:
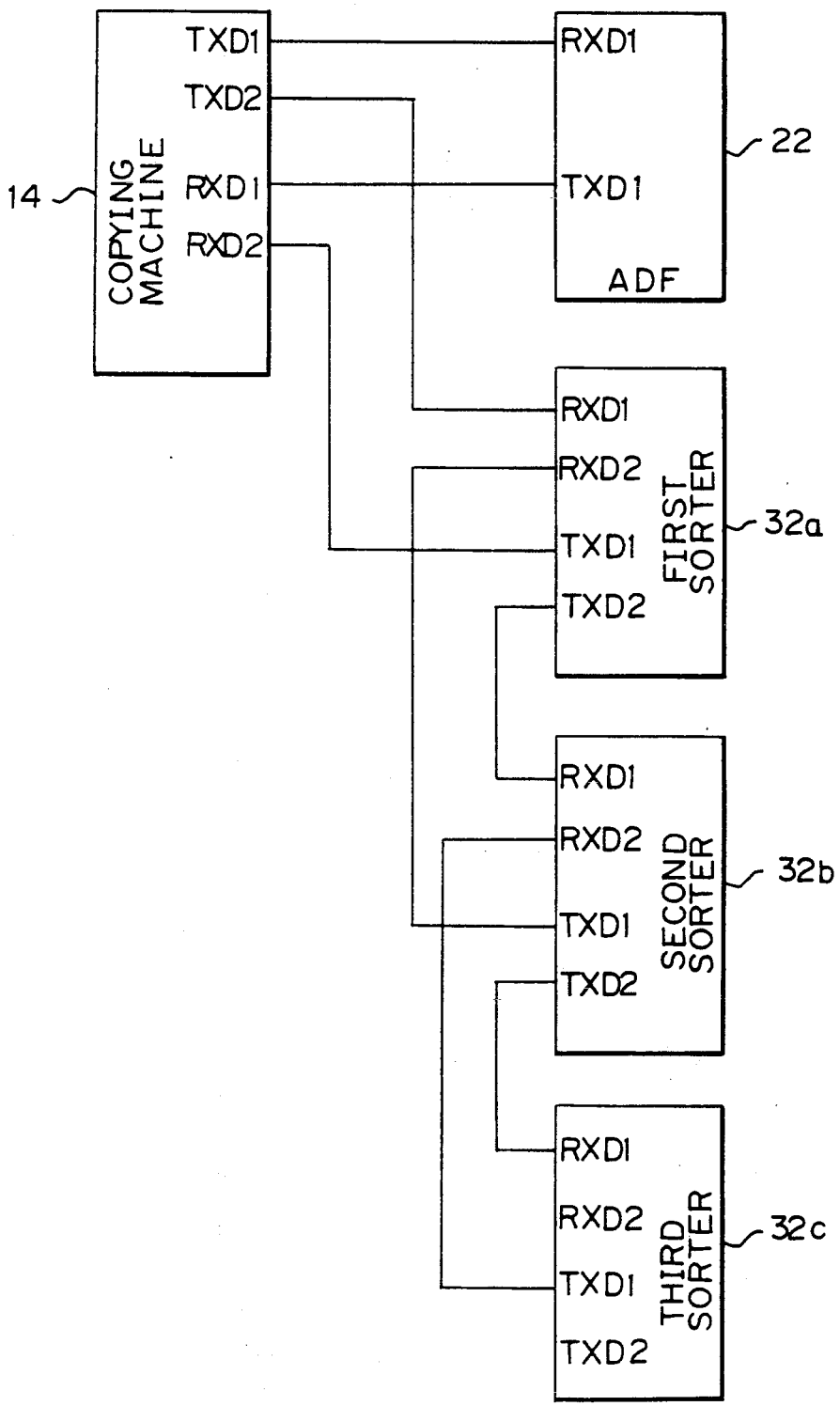
FIG. 3 shows is a connection block diagram of the serial interfaces in the copying system of FIG. 1.

As shown in FIG. 2, the copying machine 10, ADF 20, and sorters 30*a* to 30*c* contain serial interfaces 14, 22, 32*a*, 32*b* and 32*c*, respectively. Those interfaces are serially connected as shown, and have the same circuit arrangements. More detailed connection of these serial interfaces are as shown in FIG. 3. In the figure, reference character R indicates a receiving terminal and character T represents a transmitting terminal.

Figure 4:
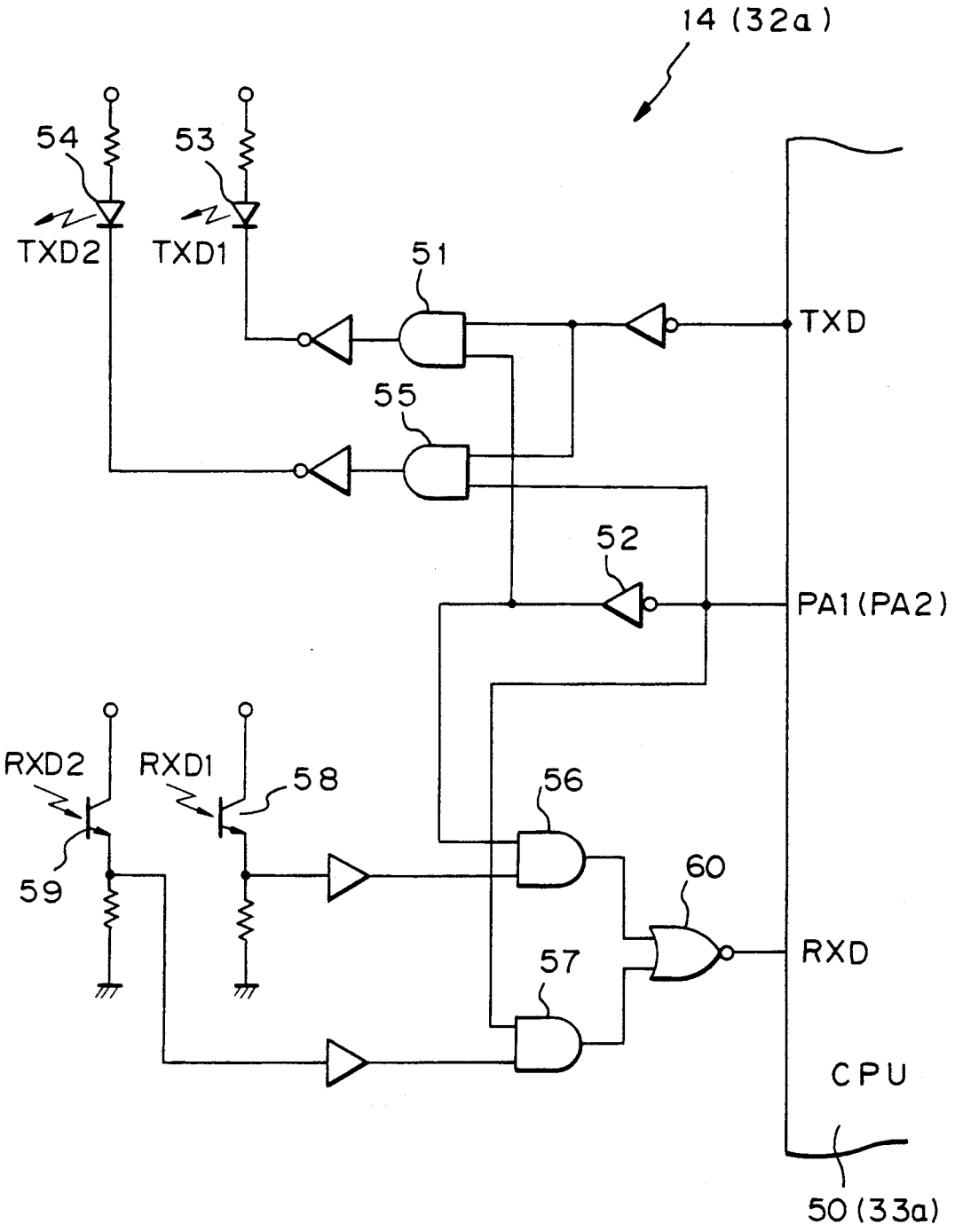
FIG. 4 shows a circuit diagram of the interface of the copying machine in the copying system of FIG. 1.

A circuit arrangement of the interface 14 of the copying machine 10 is illustrated in FIG. 4. As shown, a central processing unit (CPU) 50 of the copying machine 10 contains a control port PA1, a serial transmitting port TXD, and a serial receiving port RXD. A light emitting diode (LED) 53 for transmitting data TXD1 to the ADF 20 is provided and connected to the serial transmitting port TXD of the CPU 50, by way of an AND gate 51 and two inverters. Another LED 54 for transmitting data TXD2 to the first sorter 30*a* is also connected to the serial transmitting port TXD, by way of an AND gate 55 and two inverters. A photo transistor 58 for receiving data RXD1 from the ADF 20, is connected to the serial receiving port RXD, by way of a buffer, an AND gate 56, and a NOR gate 60. A photo transistor 59 for receiving data RXD2 from the first sorter 30*a* is connected to the serial receiving port RXD, by way of a buffer, an AND gate 57, and the NOR gate 60. The port PA1 of the CPU 50 is connected through an inverter 52 to the first input port of the AND gate 50 that is contained in the data path from the serial port TXD of the CPU 50 to the LED 53 for the ADF 20, and also to the first input port of the AND gate 56 that is contained in the data path from the photo transistor 58 for the ADF 20 to the serial receiving port RXD of the CPU 50.

For transmitting data from the copying machine 10 to the ADF 20, the CPU 50 in the copying machine 10 containing the interface 14 thus arranged places a logical "L" level at its control port PA1. The "L" level signal is inverted into an "H" level signal, which in turn is applied to the first input port of the AND gate 51. At this time, the CPU 50 transfers data TXD1 from the serial transmitting port TXD to the second input port of the AND gate 51 via the inverter. Under this condition, the AND gate 51 is enabled to allow the data signal to pass to the LED 53. The data signal reaches the LED 53 and energizes the LED 53, so that the data TXD1 is transferred to the interface 22 of the ADF 20. During this communication from the copying machine 10 to the ADF 20, the "L" level signal from the control port PA1 is directly applied to the AND gate 55, and the gate 55 remains disabled Therefore, the data from the serial transmitting port TXD will never go to the LED 54 to be coupled with the first sorter 32*a*.

To receive data from the ADF 20, the CPU 50 sets the port PA1 at an "L" level The "L" level signal is inverted by the inverter 52 and applied to the first input port of the AND gate 56. At this time, data RXD1 comes through the photo transistor 58 from the ADF 20 and reaches the other input port of the AND gate 56. At this time, the gate 56 is conditioned to allow the data RXD1 to pass therethrough and to reach the serial port RXD of the CPU 50. Also during this communication, the AND gate 57 is disabled by the "L" signal from the control port PA1, and prohibits the data RXD2 of the first sorter 30*a* coming through the photo transistor 59 from entering into the serial receiving port RXD of the CPU 50.

The data transmission between the copying machine 10 and the first sorter 30*a* will be described. As seen from FIG. 5, after receiving the data RXD1, the ADF 20 returns the data RXD1 to the copying machine 10 within a predetermined period. After receiving the data, the copying machine 10 switches the signal level at the control port PA1 from an "L" level to a "H" level. When an "L" level is set at the port PA1, the AND gate 51 is disabled, while the AND gate 55 is enabled. The data TXD2 outputted from the serial transmitting port TXD of the CPU 50 goes through the AND gate 55 and the inverter, and reaches and energizes the LED 54 to be coupled with the first sorter 30*a*. With the energization of the LED, the data TXD2 is transmitted to the first sorter 30*a*. When receiving the data RXD2 from the sorter 30*a*, the data received by the photo transistor 59 is applied to the AND gate 57. At this time, the gate 57 has received a "H" level signal from the port PA1 and is enabled to allow the data to pass there and reach the serial receiving port RXD of the CPU 50.

The circuit arrangement and the operations of the interface 14 of the copying machine 10 for receiving and transmitting the data to and from the ADF 20 and the first sorter 30*a* are substantially the same as the interfaces 32*a*, 32*b* and 33*c* of the sorters 30*a*, 30*b* and 30*c*.

Figure 5:
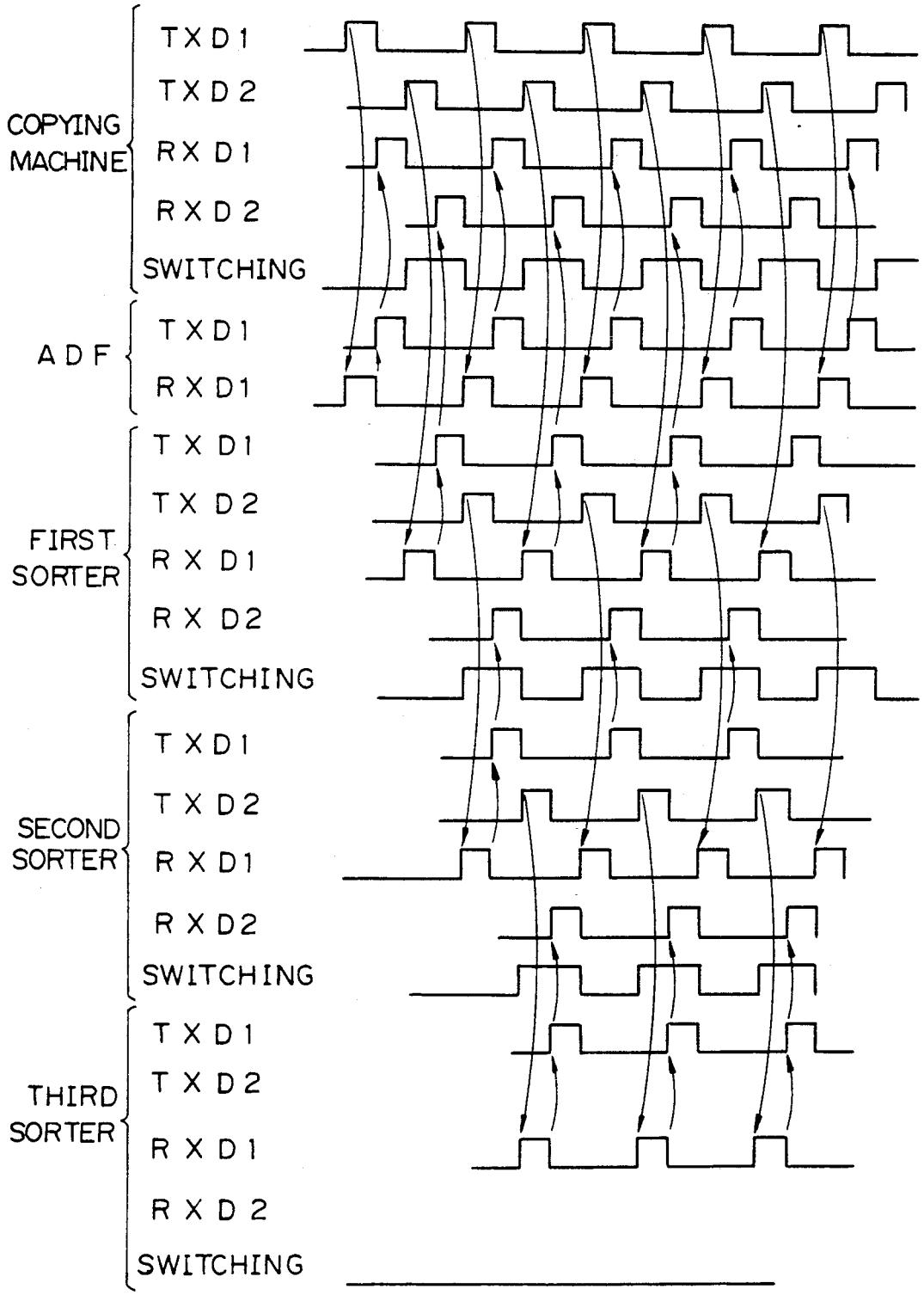
FIG. 5 shows a timing chart useful in explaining the operation of the copying system of FIG. 1.

As seen from in FIG. 5, the copying machine 10 first transmits data to the ADF 20. After receiving the data, the ADF 20 transmits data to the copying machine 10.

In other words, the ADF 20 responds to the data from the copying machine 10, and returns the data thereof to the copying machine 10.

Subsequently, the copying machine 10 transmits data to the sorter. The transmitted data contains data of paper size, on/off of motors of the sorters, bin addresses, and the like. After receiving the data from the copying machine, the sorter returns data to the copying machine. The data transmitted from the sorter contains data indicating if a copy or copies are contained in a bin or bins (of each block, if bins are arranged in blocks) in the sorter, data indicating bin address in which copies just transported have been put, and the like. In this way, the copying machine 10 transfers data to and from the ADF 20 and the sorters 30*a* to 30*c*, alternately and time divisionally.

Switching the connection of the copying machine 10 to the ADF 20 over to the connection of the copying machine to the sorter and vice versa may be realized by using a timer, for example. Specifically, at the time of starting the data transmission to the ADF 20, the timer starts its operation. The timer disconnects the machine to ADF connection and connects the machine to sorter connection, after a time slight longer than the time required for data transmission and reception. Also at the time of starting the data transmission from the first sorter 30*a* to the copying machine 10, a timer starts its operation. The timer disconnects the sorter to machine connection and connects the sorter to sorter connection, after a predetermined time. In this instance, the data used in the copying system are all coded data.

When considering a data transmission speed, the time divisional data communication by a single serial port is inferior to the conventional data communication by using individual ports. Practically, the inferiority of the data communication by the control system according to the present invention is negligible. For example, let us consider a case that data each having a 11-bit data length consisting of data of 8 bits, start bit of 1 bit, stop bit of 1 bit, and parity bit of 1 bit, are transmitted at 4800 bit/sec. In this case, approximately 4.6 msec is taken for the data transmission and reception to and from the ADF 20. If the timer switching time is set at 5 msec, the data from the ADF 20 is obtained every 10 msec. In the ADF 20 and the sorters, however, there little occurs a case that they have such data that must be processed within several tens msec.

The data transmission among the first to third sorters 30*a* to 30*c* are performed during the data transmission between the copying machine 10 and the ADF 20. During this period, data transmission will never be performed between the copying machine 10 and the sorters.

In this way, the copying machine 10 can perform the data communication with the ADF 20, and the sorters 30*a* to 30*c*, through the single serial ports RXD and TXD.

The data communication among the sorters 30*a* to 30*c* will be described.

The data transferred from the copying machine 10 to the sorter side contains mainly bin address data for sorting and distributing copies into related bins in the sorters. Additionally, it contains on/off data for turning on and off the motors, copy size data, and the like. In the copying system shown in FIG. 1, the bin rows 31*a* to 31*c* in the sorters 30*a* to 30*c* contain 20 bins, respectively. A total of 60 bins are used in this copying system. Let us consider a case that 50 copies are produced, and these copies must be sorted and put into the bin rows 31*a* to 31*c* of the sorters. In this case, the bin rows 31*a* and 31*b* of the first and second sorters 30*a* and 30*b* are completely filled with the copies of 40. The remaining 10 copies are put into 10 bins of the bin row 31*c* of the third sorter 30*c*.

Figure 6:
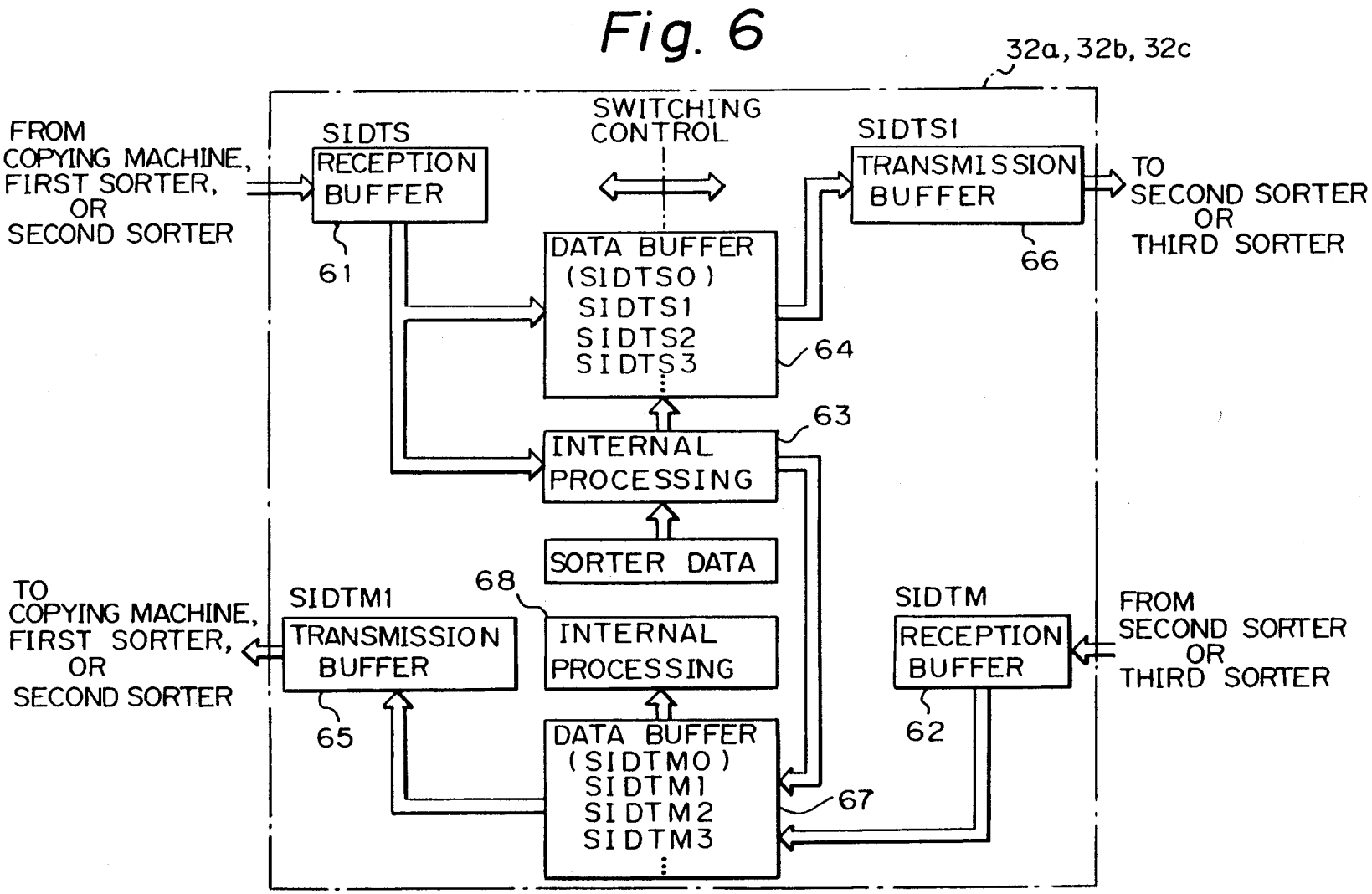
FIG. 6 shows a block diagram useful in explaining a serial data communication of a sorter and other adjacent sorters or the ADF in the copying system.

The data communication among the sorters 30*a* to 30*c*, and between the copying machine 10 and the first sorter 30*a* will be described with reference to FIG. 6 describing a sorter serial communication. Bear in mind that the serial interfaces 32*a* to 32*c* of the sorters 30*a* to 30*c* have the same circuit arrangements as already mentioned. Where the flow of the copies derived from the copying machine 10 is involved, the copying machine 10 is located upstream of the first sorter 32*a*, and the second sorter 32*b* is located downstream of the first sorter 32*a*. For the second sorter 32*b*, the first sorter 32*a* is located upstream of it, and the third sorter 32*c* is located downstream of it. For the third sorter 32*b*, the second sorter 32*b* is located upstream of it.

When one sorter, for example, the first sorter 30*a* receives data from its upstream side, the received data is stored in SIDTS of a reception buffer 61. In practice, before storing in the reception buffer 61, some operation, described in detail later, is carried out. When the data comes from the downstream side, it is stored in SIDTM of a reception buffer 62. The upstream or downstream can be discriminated by a logical state, "H" or "L", at a control port PA2 of a CPU 33*a* (FIG. 4) of the sorter 30*a*.

To be more specific, when the copying machine 10 transmits data to the first sorter 30*a*, the first sorter 30*a* loads the received data into the SIDTS of the buffer 61. The CPU 33*a* in the serial interface 32*a* determines whether or not the data received and stored in the SIDTS of the reception buffer 61 concerns the first sorter 30*a*. If the answer is "YES", or it concerns the first sorter, the data is subjected to an appropriate internal processing in a block 63. If the answer is "NO", the data is loaded into SIDTSn of a data buffer 64. Here, the data indicating if the received data concerns the first sorter 30*a* or another sorter relates mainly to sorter bins. Let us consider a case, for example, that to put copies into a 35th bin, the copying machine 10 transmits data to the first sorter 30*a*. In this case, the fist sorter 30*a* needs the bin address data of 1st to 20th bin, bins, but does not need the data of the 35th bin. Accordingly, the data of the 35th bin is stored into the SIDTSn of the data buffer 64 so as to send the data to the second sorter 30*b*. Then, status data of the first sorter 30*a* and the data from the downstream sorter are set in SIDTM1 of a transmission buffer 65, and is transmitted to the copying machine 10. After the data transmission to the upstream side is completed (it is terminated after a preset time lapses from a transmission start), the data stored in the SIDTS1 of the transmission buffer 66 is transmitted to the downstream side.

The data in the SIDTS1 of the transmission buffer 66, after it is transmitted, is temporarily stored into SIDTSn of the data buffer 64. In the data buffer 64, the data of the SIDTSn is successively stored into the SIDTS(n−1). When an data error occurs during the transmission or reception of the data, and the present sorter receives a request of a retransmission of the transmitted data, the data stored in the data buffer SIDTS0 is transmitted. In other words, for searching the data to be retransmitted, it is not necessary to go upstream beyond the data buffer SIDTSS0 in the present serial interface.

When no data to be transmitted to the downstream side is stored in the data buffer, dummy data is transmitted to maintain a synchronism of the system operation.

After transmitting the data in the SIDTS1 of the transmission buffer 66 to the downstream side, the present serial interface receives the data from the downstream side within a predetermined time. The received data is temporarily stored in the SIDTM of the reception buffer 62, and then is stored into the SIDTMn of the data buffer 67. Part of the data stored therein is subjected to an appropriate internal processing in a block 68. In the event that a jamming or any other trouble occurs in the second sorter 30*b*, the internal processing results in prohibiting the copies from being transferred to the second sorter 30*b*. Most of the data stored in the data buffer 67 are data to be sent to the upstream. The transmission of the data to the upstream is timed after the present interface receives the data from the upstream.

Thus, in transferring data among the sorters 30*a* to 30*c*, each sorter fetches only the data that is necessary for the sorter per se, while the other data than the necessary data merely pass through the interface of that sorter. This is very convenient for the control of the sorters 30*a* to 30*c*. The reason for this follows. In case that the copy machine 10 produces the address data of the 35th bin, for example, the first sorter 30*a* having 1st to 20th bins passes the 35th bin address data to the second sorter 30*b*. The the sorter 30*b* receives the 35th bin address data, and recognizes the address data concerning the sorter itself because it has the 21st to 40th bin addresses. In turn, it executes the processing of subtraction 35−20=15. On the basis of the subtraction result, the second sorter 30*b* controls its mechanism relating to a copy flow control so that the copy is put into the 15th bin as counted from the top as viewed in the flow of copies. Thus, the second sorter 32*b* subtracts the number of bins contained therein from the bin address, and uses the subtraction data as its bin address. After the subtraction is performed, viz., in this instance the address of the 15th bin is obtained, the control to be performed by the second sorter 30*b* is the same as that by the first sorter 30*a*. This indicates that the same control software is applicable for all the sorters 30*a* to 30*c*. In other words, the software must discriminate those sorters 30*a* to 30*c* one from the others, but the same random access memory (ROM) or hardware may be used for those different sorters 30*a* to 30*c*.

The above feature implies that the first to third sorters 30*a* to 30*c* may be treated as the same type of sorters in the stages of manufacturing and sales. This is very useful in inventory management and cost to manufacture. Incidentally, in conventional copying systems, the second sorter and subsequent sorters are controlled by the first sorter, and therefore a hardware arrangement of the first sorter is different from those of the remaining sorters. For the discrimination of those sorters, it can be used to check at the time of power on, as to if the reversing unit 34 is present in the sorter under the discrimination. Additionally, a transmission from the first sorter 30*a* may make the discrimination. Furthermore, manually setting switches may be used, such as DIP switches, for the discrimination in such a way that the switch for the first sorter 30*a* is set in on state, while the switches for the remaining sorters are set in off state.

Turning now to FIGS. 7*a* through 7*c*, 8 and 9, there are shown flowcharts of subroutine programs for controlling the transmission and reception of data through the serial ports TXD and RXD in one of the sorters, for example, the first sorter.

Figure 7A:
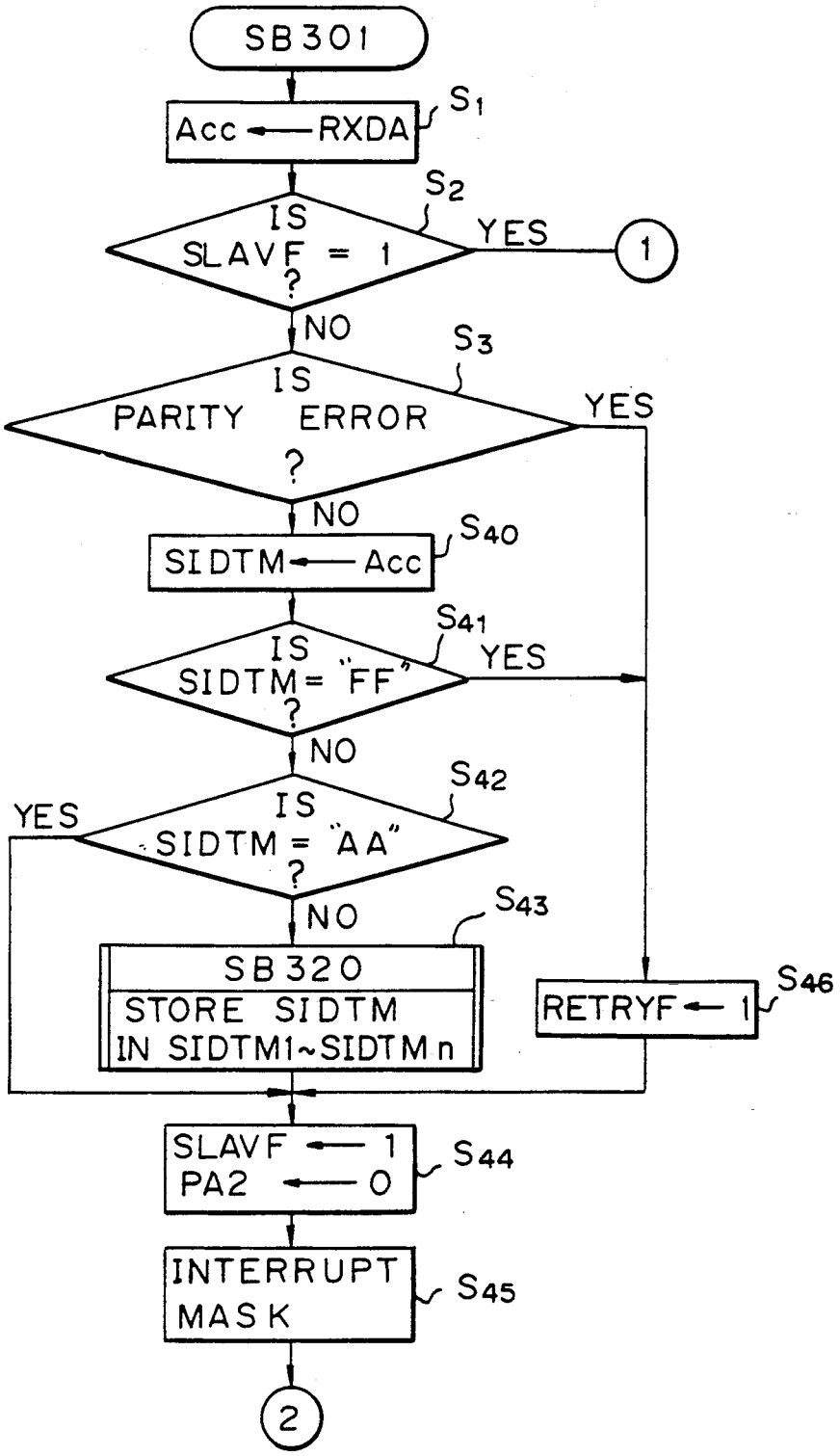
FIGS. 7*a*, 7*b*, 7*c*, 8 and 9 cooperate to show flowcharts of subroutine programs for driving a central processing unit (CPU) contained in each serial interface of each of the ADF and the sorters in the copying system of FIG. 1.
Figure 7B:
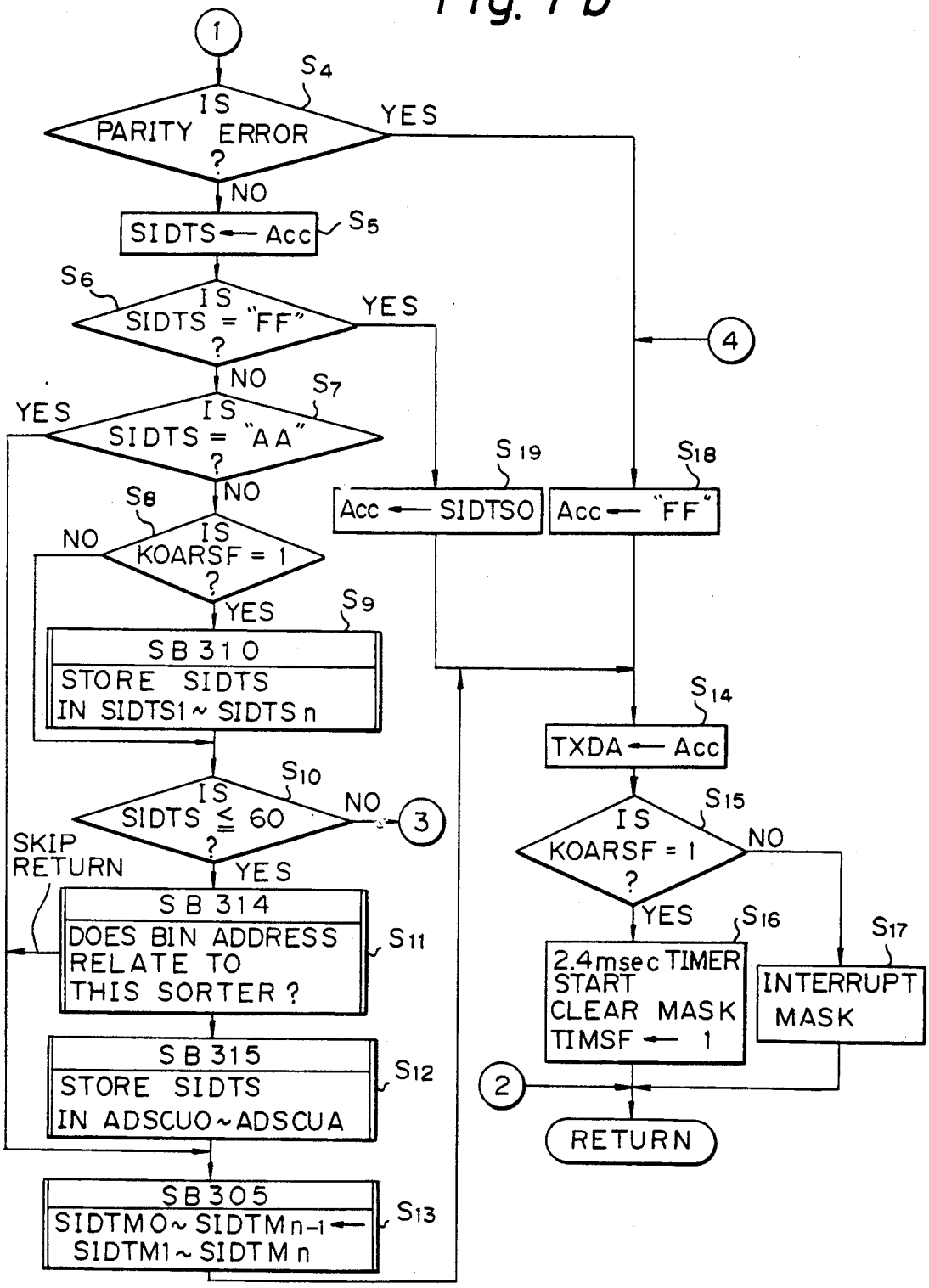
Figure 7C:
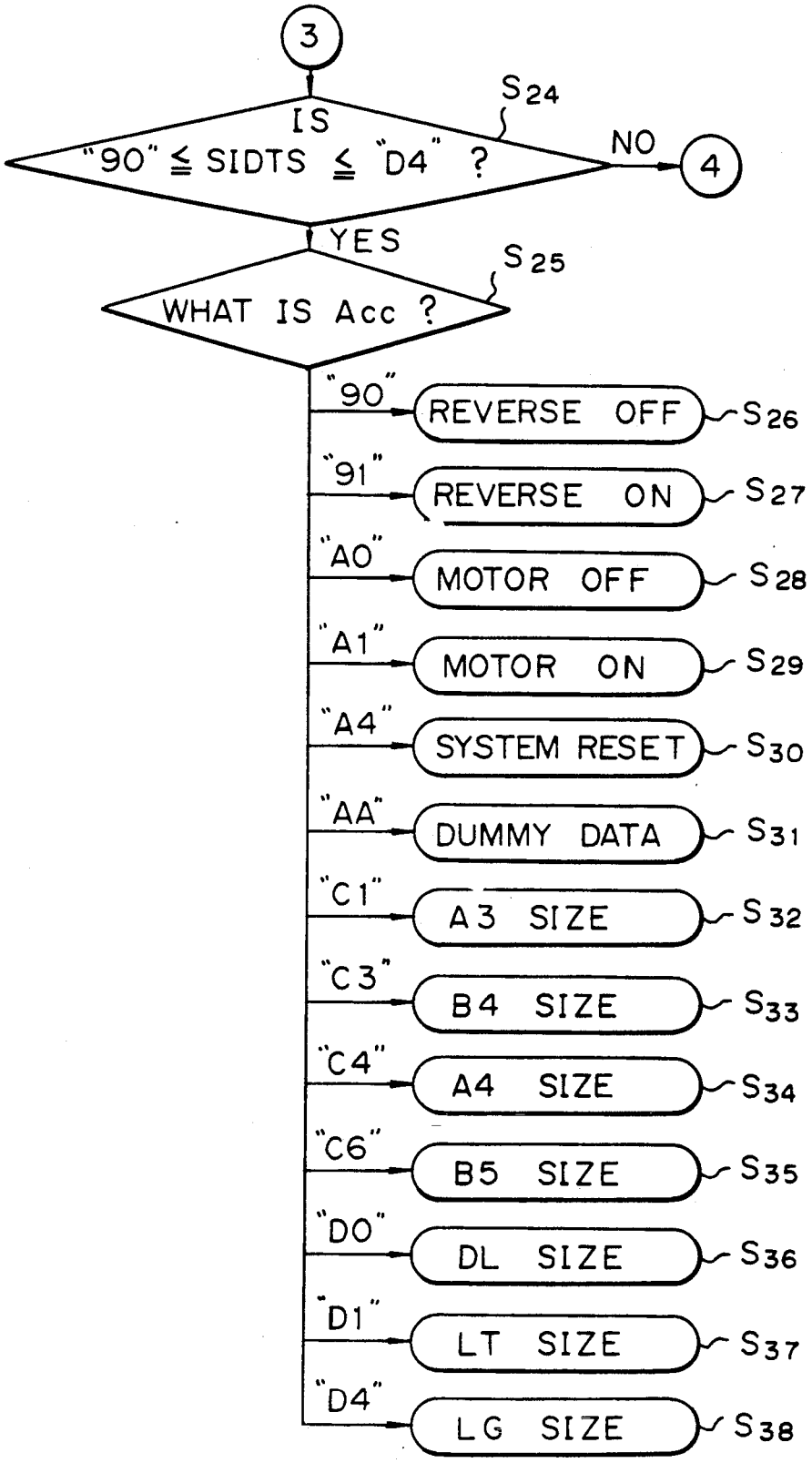

When a sorter receives data from the machine located upstream or downstream of the sorter, a main program is interrupted, and a subroutine program SB301 is executed as shown in FIGS. 7*a* through 7*c*. In this case, if the sorter receiving the data or under discussion is the first sorter 30*a*, for example, the upstream machine is the copying machine 20, and the downstream machine is the second sorter 30*b*.

In the subroutine, to start, Step S1 is executed, to load the data RXDA that is received by the sorter via its serial ports RXD, into an accumulator Acc of the CPU of the sorter. In the next Step S2, control checks if a flag SLAVF is "1". This flag is used to indicate the data originating source from which the present received data comes, viz., the upstream machine or the downstream machine. If the source is the downstream machine, control advances to Step S3. If it is upstream, the CPU advances to STep S4 (FIG. 7*b*). Let us assume now that the data from the upstream machine is received. Then, control makes a parity check in Step S4. If a parity error is present, control goes to Step S18. In this step, retry-request data is loaded into the accumulator Acc and Step S14 is executed to send the retry-request data to the upstream machine. FIG. 10 shows a code map of 8-bit data that is transferred from the main controller (CPU 50) of the copying machine to the sorter. In the code map, the value in the horizontal line consists of the upper order bits of four, while the value in the vertical line, the lower order bits of four. As seen from the code map, the retry-request data is "FF".

If no parity error is present, control reads the data RXDA out of the accumulator Acc in Step S5, and loads it into the SIDTS of the buffer 61. In the next Step S6, control checks whether or not the upstream sorter has requested a retry of the received data. In other words, the CPU checks whether or not the data in the SIDTS of the buffer 61 is "FF". If the answer is "YES", control proceeds to Step S19. In this step, the data of SIDTS0 previously transmitted to the downstream sorter that is stored in the data buffer 61, is stored into the accumulator Acc. Then, control goes to Step S14. If the answer is "NO", Step S7 is executed.

In Step S7, control checks whether or not the data in the SIDTS of the buffer 61 is "AA", i.e., dummy data. If the answer is "YES", Step S13 is executed. If "NO", Step S8 is executed. In Step S8, control checks as to if a flag KOARSF is "1", viz., whether or not another sorter is present downstream of the sorter under discussion. If "YES", control goes to Step S9. In this step, a subroutine SB310 is executed and the data of the SIDTS of the buffer 61 into an empty storage location of the storage locations SIDTS1 to SIDTSn of the buffer 64. If "NO", control jumps to Step S10, because there is no need for storing the data into the data buffer 64 in preparation for transferring the data to the downstream sorter. In Step S10, control checks if the data in the SIDTS of the buffer 61 is "3C" (=60) or less, viz., the data is the bin address data. As seen from FIG. 10, the bin address is assigned to "01" to "3C2."

Figure 8:
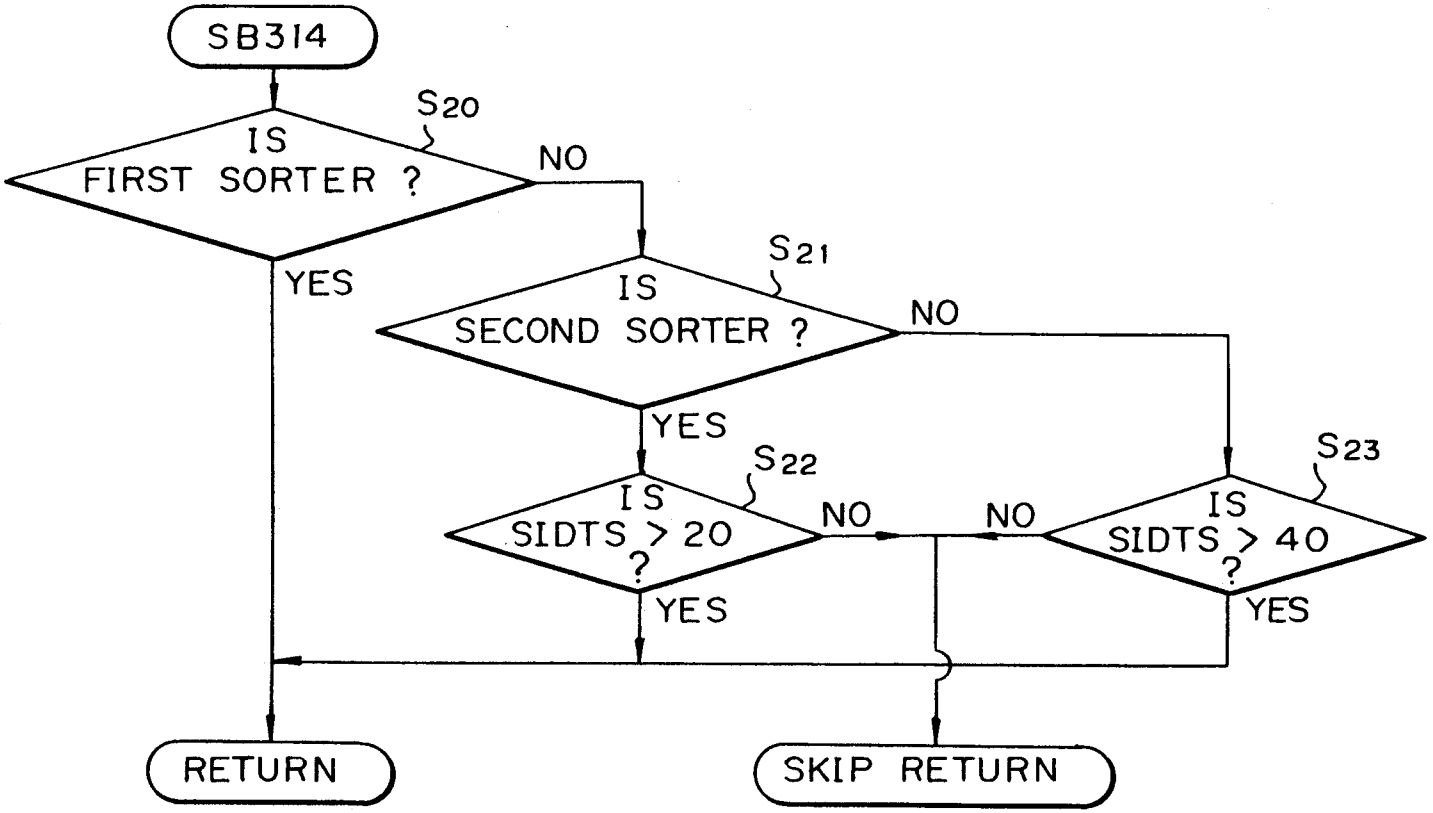
Figure 9:
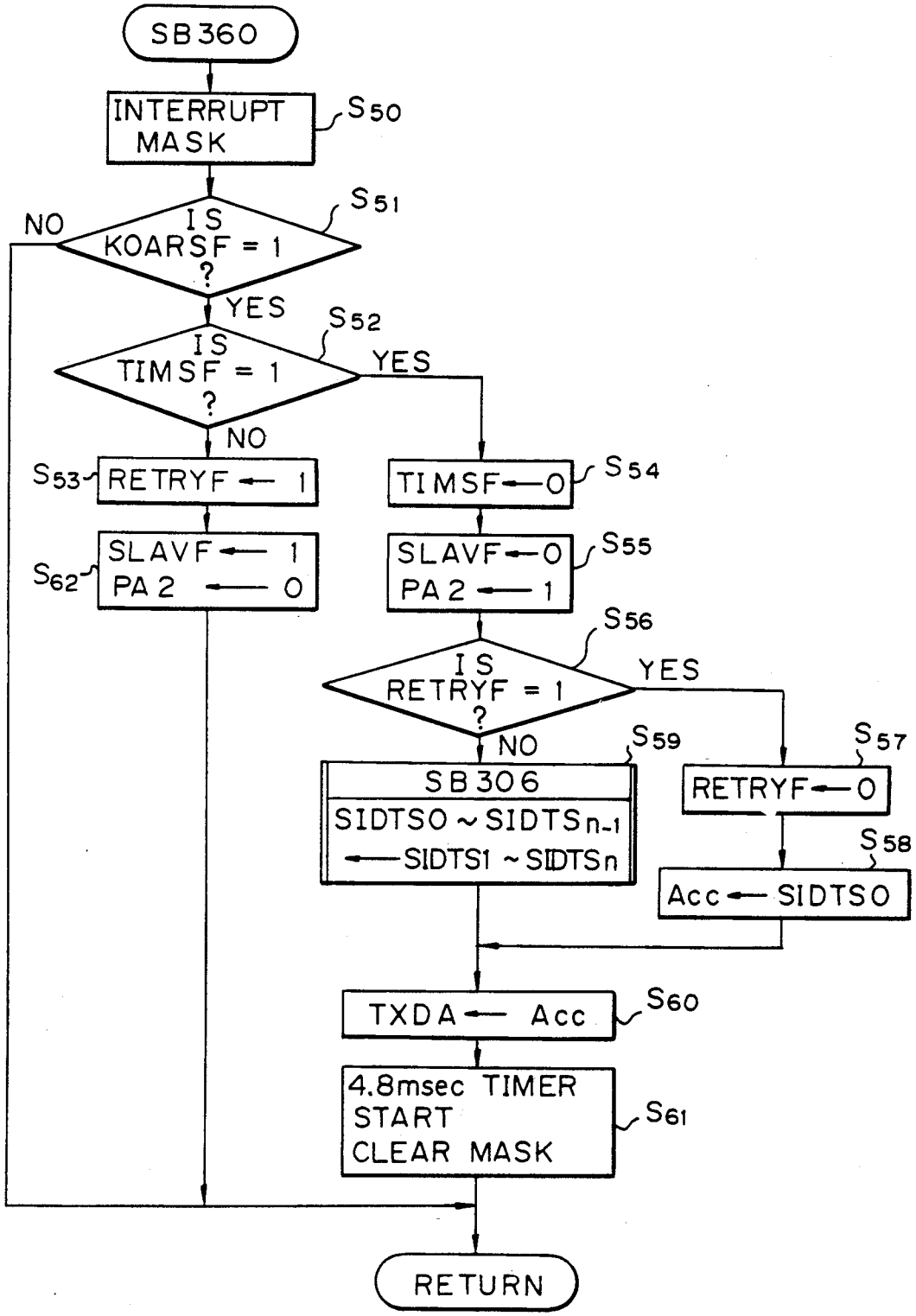

If the data is not the bin address data, a program of FIG. 7*c* is executed. If the bin address data, control goes to Step S11, to execute a subroutine SB314. This subroutine checks as to whether or not the bin address in the SIDTS of the buffer 61 concerns the sorter under discussion. The details of the subroutine are illustrated in FIG. 8. In the figure, Step S20 is first executed to check if the sorter under discussion is the first sorter. If the answer is "YES", control returns to the flow of the subroutine SB310 and progresses to Step S12 in the subroutine SB310. If "NO", Step S21 is executed to check if the sorter is the second sorter. If the answer is "YES" in Step S21, Step S22 is executed to check whether or not the bin address in the SIDTS of the buffer 61 is larger than "20". If the answer is "YES", control returns to Step S12. If "NO", control advances to Step S13. If the answer is "NO" in step S21, control advances to Sep S23 to check whether or not the bin address in the SIDTS of the buffer 61 is larger than "40". If the answer is "YES", control returns to the main flow of the subroutine and goes to Step S12. If the answer is "NO", control skips and returns to the main flow of the subroutine, and proceeds to Step S13. In Step S12, a subroutine SB315 is executed. This subroutine stores the data in the SIDTS of the buffer 61 into an empty storage location of the storage locations ADSCUO to ADSCUA.

In Step S13, a subroutine SB305 is for a preparatory processing for transmitting data to the upstream machine. In this subroutine, so long as the data to be transmitted is present in the data buffer 67, the contents in the SIDTM1 to SIDTMn are successively transferred to the SIDTM0 to SIDTMn−1. When the data to be transmitted is absent, dummy data "AA" is loaded into the accumulator Acc. In the next Step S14, the contents of the accumulator Acc is transferred as transmission data TXDA through the serial port TXD to the upstream machine.

In Step S15, as in Step S8, control checks if the flag KOARSF is "1", viz., whether or not there is another sorter downstream of the present sorter. If the answer is "YES", control proceeds to Step S16. If it is "NO", control goes to Step S17. In Step S16, control starts a 2.4 msec-timer to indicate an instance that data is transmitted to the downstream machine, removes a timer interrupt mask processing, and sets a flag TIMSF indicating the start of the 2.4 msec-timer to "1", and then returns to the main flow of the subroutine. In Step S17, control executes a timer interrupt mask processing and then returns to the main flow.

In Step S10, if the data is not the bin address data, control executes a program of FIG. 7*c*. In Step S10, control checks whether or not the data in the SIDTS of the buffer 61 is within "90" to "D4". The code map within this range is assigned to the other data than the bin address. Accordingly, only when the answer is "YES", control advances to Step S24, and recognizes the contents, or the received data, in the accumulator Acc. Relationships between the data codes of the received data and their meanings are listed in the following table.

TABLE

| Code | Meaning |
|---|---|
| "90" | Turn off the reversing unit 34 (Step S26) |
| "91" | Turn on the reversing unit 34 (Step S27) |
| "A0" | Turn off the paper feed motor in the sorter (Step S28) |
| "A1" | Turn on the paper feed motor in the sorter (Step S29) |
| "A4" | Reset the system (Step S30) |
| "AA" | Dummy data (Step S31) |
| "C1" | A3 size paper (Step S32) |
| "C3" | B4 size paper (Step S33) |
| "C4" | A4 size paper (Step S34) |

TABLE-continued

| Code | Meaning |
|---|---|
| "C6" | B5 size paper (Step S35) |
| "D0" | Double letter size paper (Step S36) |
| "D1" | Letter size paper (Step S37) |
| "D4" | legal letter size paper (Step S38) |

If control decides in Step S32 that the received data comes from the downstream machine, control goes to Step S3 of FIG. 7*a* as already mentioned. In this step, control executes a parity error check. If a parity error exists, control proceeds to Step S46, to set a flag RETRYF to request a retry. Then, it goes to Step S44. If no parity error exists, control executes Step S40 to store the contents RXDA of the accumulator Acc into the SIDTM of the buffer 67. In Step S41, control checks whether or not the downstream sorter has requested a retry of the received data, that is, whether or not the data in the STDTM of the buffer 67 is "FF". If the answer is "YES", control goes to Step S46. If the answer is "NO", control goes to Step S42. In Step S42, control checks whether or not the data in the SIDTM of the buffer 67 is "AA", that is, the data is the dummy data. If it is the dummy data, control proceeds to Step S44. If it is not the dummy data, control proceeds to Step S43. In Step S43, t subroutine SB320 is executed. The data in the SIDTM of the buffer 67 is stored in an empty storage location of the SIDTM1 to SIDTMn.

In Step S44, the flag SLAVF is set to "1" and the control port PA2 is set to "0", to switch the serial ports TXD and RXD to the upstream machine. In the next Step S45, the control executes the timer interrupt mask processing, and returns to the main flow.

After the transmission of data to the upstream machine is conditioned, and 2.4 msec elapses, the timer interrupt occurs and a subroutine SB360 is executed. In Step S50, the timer interrupt is masked, and in Step S51, control checks if the flag KOARSF is "1", viz., whether or not there is another sorter downstream of the sorter under discussion, as in Steps S8 and S15. If the answer is "YES", control goes to Step S52. If the answer is "NO", the control returns to the main flow, because no downstream sorter exists. In Step S52, control checks whether or not the flag TIMSF is "1", that is, the 2.4 msec timer has started. If "NO", control goes to Step S53 because the timer does not operate. If "YES", Step S54 is executed. In Step S54, the flag TIMSF is set to "0". In the next Step S55, the flag SLAVF is set to "0", and the control port PA2 is set to "21", to switch the serial ports TXD and RXD to the downstream side. In Step S56, control checks if the retry-request flag RETRYF is "1".

When a retry request is present, control proceeds to Step S57, to set the flag RETRYF to "0", and reaches Step S58. In this step, stores the contents of the SIDTS0 of the data buffer 64, or the previously transmitted data, into the accumulator Acc, in order that in Step S60, the data will be transmitted again to the downstream machine. When no retry request is present, control goes to Step S59 where it executes the subroutine SB306 for a preparatory processing to transmit data to the downstream machine. So long as the data to be transmitted is present in the buffer 64, the contents in the SIDTS1 to SITDSn are carried to the SIDTS0 to SIDTSn−1 in successive order. When such data is absent, the dummy data "AA" is stored into the accumulator Acc. In Step S60, the contents of the accumulator Acc are transferred as transmission data TXDA to the downstream machine. Then, in Step S61, control starts the 4.8 msec-timer to check whether or not there is a data transmission from the downstream machine within a predetermined period of time after data is transmitted to the downstream machine. Further, control remove the timer interrupt mask processing, and returns to the main flow.

If the flag TIMSF is set to "0" in Step S52, control advances to Step S53 because the data has been transmitted to the downstream machine, and sets the retry-request flag RETRYF to "1". In the next Step S62, the flag SLAVF is set to "21" and the control port PA2 is set to "20" to switch the serial ports TXD and RXD to the upstream side. Then, control returns to the main flow.

FIG. 11 shows a code map of the 8-bit data transmitted from the sorter side to the main controller (CPU 50) of the copying machine. The value in the horizontal line consists of the upper order bits of four, while the value in the vertical line, the lower order bits of four. For example, "60" indicate that no paper is present in the 1st to 20th bins; "61", paper is present in the 1st to 20th bins; "70", the door of the sorter with the 1st to 20th bins is closed; "71", the door of the sorter with the 1st to 20th bins is open; "80", no jumming occurs in the sorter with the 1st to 20th bins; and "81", jumming occurs in the sorter with the 1st to 20th bins.

While the description thus far given relates to the data transmission/reception by one sorter, for example, the first sorter, the main controller of the copying machine may also carry out the transmission and reception of data to and from the adjacent machine by using the serial ports TXD and RXD in a similar way.

Many widely different embodiments of the present invention may be constructed without departing from the spirit and scope of the present invention. It should be understood that the present invention is not limited to the specific embodiments described in this specification, except as defined in the appended claims.

What is claimed is:

1. A method of controlling data communication in a copying system which is provided with a copying machine and a plurality of peripheral units cooperating with said copying machine, said copy machine having a single serial transmitting port, said method comprising the steps of:

transmitting data from said copying machine to one peripheral unit of said plurality of peripheral units through said serial transmitting port;

electrically switching a connection between said serial transmitting port and said one peripheral unit to a connection between said serial transmitting port and another peripheral unit which is different from said one peripheral unit in type and kind after a predetermined time from a data transmission to said one peripheral unit is started, said predetermined time being longer than a period for transmitting said data from said copying machine to said one peripheral unit wherein said electrical switching includes providing a single central processing unit in the copying machine and providing an interface circuit responsive to said central processing unit and connected to said serial transmitting port wherein the providing of said interface circuit includes the providing of a plurality of logic gates responsive to a control signal from said central processing unit in order to provide said connection between said serial transmitting port and a selected one of said peripheral units for said predetermined time; and transmitting data from said copying machine to said another peripheral unit directly through said serial transmitting port after said switching step.

2. A method as claimed in claim 1, wherein said peripheral units are an automatic document feeder and a sorter.

3. A method as claimed in claim 1, wherein said peripheral units are an automatic document feeder and at least two sorters.

4. A method as claimed in claim 3, wherein said one peripheral unit is one of said sorters and said another peripheral unit is said automatic document feeder.

5. A method as claimed in claim 3, wherein said one of said sorters has a single serial receiving port, and wherein said method further comprises the steps of:

receiving the data from said copying machine directly through said serial receiving port;

electrically switching a connection between said serial receiving port and said serial transmitting port of said copying machine to a connection between said serial receiving port and the other sorter; and receiving data from the other sorter through said serial receiving port in a period of transmission of data from said copying machine to said document feeder.

6. A method as claimed in claim 5, wherein said one of the sorters has a single serial transmitting port, and wherein said method further comprises the steps of:

transmitting data from said one of the sorters to said copying machine directly through said serial transmitting port of said sorter;

electrically switching a connection between said serial transmitting port and said copying machine to a connection between said serial transmitting port of said sorter and the other sorter; and transmitting data from said sorter to the other sorter through said serial transmitting port in a period of transmission of data from said copying machine to said document feeder.

7. A method of controlling data communication in a copying machine system which is provided with a copying machine and a plurality of peripheral units cooperating with said copying machine, said copying machine having a single serial transmitting port, said method comprising steps of:

receiving data from one peripheral unit of said plurality of peripheral units directly through said serial receiving port;

electrically switching a connection between said serial transmitting port and said one peripheral unit to a connection between said serial transmitting port and another peripheral unit which is different from said one peripheral unit in type and kind after a predetermined time from data receipt from said one peripheral unit is started, said predetermined time being longer than a period for receiving data from said one peripheral unit wherein said electrical switching includes providing a single central processing unit in the copying machine and providing an interface circuit responsive to said central processing unit and connected to said serial transmitting port wherein the providing of said interface circuit includes the providing of a plurality of logic gates responsive to a control signal from said central processing unit in order to provide said connection between said serial transmitting port and a selected one of said peripheral units for said predetermined time; and receiving data from said another peripheral unit directly through said serial receiving port after said switching step.

8. A method as claimed in claim 7, wherein said peripheral units are an automatic document feeder and a sorter.

9. A method as claimed in claim 7, wherein said peripheral units are an automatic document feeder and at least two sorters.

10. A method as claimed in claim 9, wherein said one unit is one of said sorters and said another peripheral unit is said automatic feeder.

11. A method as claimed in claim 10, wherein said one of said sorters has a single serial receiving port, and wherein said method further comprises the steps of:

receiving data from said copying machine directly through said serial receiving port of said sorter;

electrically switching a connection between said serial receiving port of said sorter and said copying machine to a connection between said serial receiving port of said sorter and the other sorter; and receiving data from the other sorter through said serial receiving port of said sorter in a period of receiving data from said document feeder through said serial receiving port of said copying machine.

12. A method as claimed in claim 11, wherein said one of the sorters has a single serial transmitting port, and wherein said method further comprises the steps of:

transmitting data from said one of the sorters to said copying machine directly through said serial transmitting port;

electrically switching a connection between said serial transmitting port and said copying machine to a connection between said serial transmitting port and the other sorter; and transmitting data from said sorter to the other sorter through said serial transmitting port in a period of receiving data from said document feeder through said serial receiving port of said copying machine.

13. A method of controlling data communication in a copying system which is provided with a copying machine and a plurality of peripheral units cooperating with said copying machine, said copying machine having a single serial transmitting port, said method comprising the steps of:

transmitting data from said copying machine to one peripheral unit of said plurality of peripheral units directly through said serial transmitting port;

receiving data from said one peripheral unit directly through said serial receiving port;

electrically switching a connection between said serial transmitting port and said one peripheral unit and a connection between said serial receiving port and said one peripheral unit to a connection between said serial transmitting port and another peripheral unit which is different from said one peripheral unit in type and kind and a connection between said serial receiving port and said another peripheral unit respectively after an elapse of a predetermine time from a data transmission to said one peripheral unit is started, said predetermined time being longer than a period for transmitting data to and receiving data from said one peripheral unit wherein said electrical switching includes providing a single central processing unit in the conveying machine and providing an interface circuit responsive to said central processing unit and connected to said serial transmitting port wherein the providing of said interface circuit includes the providing of a plurality of logic gates responsive to a control signal from said central processing unit in order to provide said connection between said serial transmitting port and a selected one of said peripheral units for said predetermined time; and transmitting data from said copying machine to said another peripheral unit directly through said serial transmitting port; and receiving data from said another peripheral unit directly through said serial receiving port.

14. A method as claimed in claim 13, wherein said peripheral units are an automatic document feeder and a sorter.

15. A method as claimed in claim 13, wherein said peripheral units are an automatic document feeder and at least two sorters.

16. A method as claimed in claim 15, wherein said one peripheral unit is one of said sorters and another peripheral unit is said automatic document feeder.

17. A method as claimed in claim 16, wherein said one of said sorters has a single serial receiving port, and wherein said method further comprises the steps of:

receiving data from said copying machine directly through said receiving port of said sorter;

electrically switching a connection between said serial receiving port of said sorter and said serial transmitting port of said copying machine to a connection between said serial receiving port of said sorter and the other sorter; and receiving data from the other sorter through said serial receiving port of said sorter in period of transmission of data from said copying machine to said document feeder and receiving data from said document feeder.

18. A method of claimed in claim 17, wherein said one of the sorters has a single serial transmitting port, and wherein said method further comprises the steps of:

transmitting data from said sorter to said copying machine directly through said serial transmitting port of said sorter;

electrically switching a connection between said serial transmitting port of said sorter and said serial receiving port of said copying machine to a connection between said serial transmitting port of said sorter and the other sorter; and transmitting data from said sorter to the other sorter through said serial transmitting port of said sorter in a period of transmission of data from said copying machine to said document feeder and receiving data from said document feeder.

19. An apparatus for controlling data communication in a copying system which is provided with a copying machine and a plurality of peripheral units cooperating with said copying machine, said copying machine having a single serial transmitting port, said apparatus comprising:

means for transmitting data from said copying machine to one peripheral unit of said plurality of peripheral units directly through said serial transmitting port;

means for electrically switching a connection between said serial transmitting port and said one peripheral unit to a connection between said serial transmitting port and another peripheral unit which is different from said one peripheral unit in type and kind after an elapse of a predetermined time from a data transmission to said one peripheral unit is started, said predetermined time being loner than a period for transmitting said data from said copying machine to said one peripheral unit wherein said means for electrically switching includes a single central processing unit in said copying machine and an interface circuit responsive to said central processing unit and connected to said serial transmitting port wherein said interface circuit includes a plurality of logic gates responsive to a control signal from said central processing unit to provide said connection between said serial transmitting Port and a selected one of said peripheral units for said predetermined time; and means for transmitting data from said copying machine to said another peripheral unit directly through said serial transmitting port after said switching.

20. An apparatus as claimed in claim 19, wherein said peripheral units are an automatic document feeder and a sorter.

21. An apparatus as claimed in claim 19, wherein said peripheral units are an automatic document feeder and at least two sorters.

22. An apparatus as claimed in claim 21, wherein said one peripheral unit is one of said sorters and said another peripheral unit is said automatic document feeder.

23. An apparatus as claimed in claim 21, wherein said one of said sorters has a single serial receiving port, and wherein said apparatus further comprises:

means for receiving the data from said copying machine directly through said serial receiving port;

means for electrically switching a connection between said serial receiving port and said serial transmitting port of said copying machine to a connection between said serial receiving port and the other sorter; and means for receiving data from the other sorter through said serial receiving port, after said switching, in a period of transmission of data from said copying machine to said document feeder.

24. An apparatus as claimed in claim 23, wherein said one of the sorters has a single serial transmitting port, and wherein said apparatus comprises:

means for transmitting data from said one of the sorters to said copying machine directly through said serial transmitting port of said sorter;

means for electrically switching a connection between said serial transmitting port and said copying machine to a connection between said serial transmitting port of said sorter and the other porter; and means for transmitting data from said sorter to the other sorter through said serial transmitting port, after said switching, in a period of transmission of data from said copying machine to said document feeder.

25. An apparatus for controlling data communication in a copying system which is provided with a copying machine and a plurality of peripheral units cooperating with said copying machine, said copying machine having a single serial receiving port, said apparatus comprising:

means for receiving data from one peripheral unit of said plurality of peripheral units directly through said serial receiving port;

means for electrically switching a connection between said serial receiving port and said one peripheral unit to a connection between said serial receiving port and another peripheral unit which is different from said one peripheral unit in type and kind after an elapse of a predetermined time from data receipt from said one of said peripheral units is started, said predetermined time being longer than a period for receiving data from said one peripheral unit wherein said electrical switching includes providing a single central processing unit in the copying machine and providing an interface unit responsive to said central processing unit and connected to said serial transmitting port wherein the providing of said interface circuit includes the providing of a plurality of logic gates responsive to a control signal from said central processing unit in order to provide said connection between said serial transmitting port and a selected one of said peripheral units for said predetermined time; and means for receiving data from said another peripheral unit directly through said serial receiving port after said switching.

26. An apparatus as claimed in claim 25, wherein said peripheral units are an automatic document feeder and a sorter.

27. An apparatus as claimed in claim 25, wherein said peripheral units are an automatic document feeder and at least two sorters.

28. An apparatus as claimed in claim 27, wherein said one peripheral unit is one of said sorters and said another peripheral unit is said automatic document feeder.

29. An apparatus as claimed in claim 28, wherein said one of said sorters has a single serial receiving port, and wherein said apparatus further comprises:

means for receiving data from said copying machine directly through said serial receiving port of said sorter;

means for electrically switching a connection between said serial receiving port of said sorter and said copying machine to a connection between said serial receiving port of said sorter and the other sorter; and means for receiving data from the other sorter through said serial receiving port of said sorter, after said switching, in a period of receiving data from said document feeder through said serial receiving port of said copying machine.

30. An apparatus as claimed in claim 29, wherein said one of the sorters has a single serial transmitting port, and wherein said apparatus further comprises:

means for transmitting data from said one of the sorters to said copying machine directly through said serial transmitting port;

means for electrically switching a connection between said serial transmitting pot and said copying machine to a connection between said serial transmitting port and the other sorter; and means for transmitting data from said sorter to the other sorter through said serial transmitting port, after said switching, in a period of receiving data from said document feeder through said serial receiving port of said copying machine.

31. An apparatus for controlling data communication in a copying system which is provided with a copying machine and a plurality of peripheral units cooperating with said copying machine, said copying machine having a single serial transmitting port and a single serial receiving port, said apparatus comprising:

means for transmitting data from said copying machine to one peripheral unit of said plurality of peripheral units directly through said serial transmitting port;

means for receiving data from said one peripheral unit directly through said serial receiving port;

means for electrically switching a connection between said serial transmitting port and said one peripheral unit and a connection between said serial receiving port and said one peripheral unit to a connection between said serial transmitting port and another peripheral unit which is different from said one peripheral unit in type and kind and a connection between said serial receiving port and said another peripheral unit respectively after an elapse of a predetermined time longer than a period for transmitting data to and receiving data from said one peripheral unit wherein said electrical switching includes providing a single central processing unit in the copying machine and providing an interface circuit responsive to said central processing unit and connected to said serial transmitting port wherein the providing of said interface circuit includes the providing of a plurality of logic gates responsive to a control signal from said central processing unit in order to provide said connection between said serial transmitting port and a peripheral units from said peripheral units for said predetermined time;

means for transmitting data from said copying machine to said another peripheral unit directly through said serial transmitting port after said switching; and means for receiving data from said another peripheral unit directly through said serial receiving port after said switching.

32. An apparatus as claimed in claim 31, wherein said peripheral units are an automatic document feeder and a sorter.

33. An apparatus as claimed in claim 31, wherein said peripheral units are an automatic document feeder and at least two sorters.

34. An apparatus as claimed in claim 33, wherein said one peripheral unit is one of said sorters and said another peripheral unit is said automatic document feeder.

35. An apparatus as claimed in claim 34, wherein said one of said sorters has a single serial receiving port, and wherein said apparatus further comprises:

means for receiving the data from said copying machine directly through said receiving port of said sorter;

means for electrically switching a connection between said serial receiving port of said sorter and said serial transmitting port of said copying machine to a connection between said serial receiving port of said sorter and the other sorter; and means for receiving data from the other sorter through said serial receiving port of said sorter, after said switching, in a period of transmission of data from said copying machine to said document feeder and for receiving data from said document feeder.

36. An apparatus as claimed in claim 32, wherein said one of the sorters has a single serial transmitting port, and wherein said apparatus further comprises:

means for transmitting data from said sorter to said copying machine directly through said serial transmitting port of said porter;

means for electrically switching a connection between said serial transmitting port of said sorter and said serial receiving port of said copying machine to a connection between said serial transmitting port of said sorter and the other sorter; and means for transmitting data from said sorter to the other sorter through said serial transmitting port of said sorter, after said switching, in a period of transmission data from said copying machine to said document feeder and for receiving data from said document feeder.

* * * * *